United States Patent [19]

van Geffen

[11] 4,177,659

[45] Dec. 11, 1979

[54] ROTATABLE PIERCING TOOLS FOR FORMING HOLES SURROUNDED EACH BY A BOSS IN METAL PLATES OR THE WALL OF METAL TUBES

[75] Inventor: Johannes A. van Geffen, Apeldoorn, Netherlands

[73] Assignee: Technisch Handels- en Adviesbureau van Geffen B.V., Apeldoorn, Netherlands

[21] Appl. No.: 871,975

[22] Filed: Jan. 24, 1978

[30] Foreign Application Priority Data

Jan. 27, 1977 [NL] Netherlands ..... 7700872

[51] Int. Cl.[2] ..... B21D 28/36

[52] U.S. Cl. ..... 72/71; 72/325

[58] Field of Search ..... 72/71, 325; 408/224

[56] References Cited

U.S. PATENT DOCUMENTS

| | | | |
|---|---|---|---|
| 1,383,840 | 7/1921 | Mueller et al. | 72/71 |
| 2,362,260 | 11/1944 | Foster | 408/224 |

FOREIGN PATENT DOCUMENTS

| | | | |
|---|---|---|---|
| 1455276 | 11/1976 | United Kingdom | 72/325 |

*Primary Examiner*—Lowell A. Larson

*Attorney, Agent, or Firm*—Snyder, Brown & Ramik

[57] ABSTRACT

A rapidly rotatable piercing tool for forming, substantially by frictional heat and pressure, a bossed hole in a metal plate or tube wall, said tool comprising a head of greater diameter, whereby a shoulder facing the leading end of the tool is formed for so shaping one of the end faces of the boss surrounding the hole, as to round off, to bevel off or to deepen said end face towards the hole in an annular region bordering the hole.

6 Claims, 9 Drawing Figures

Figure 1:
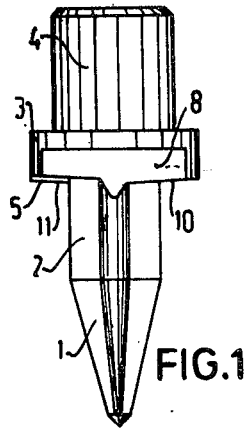

ROTATABLE PIERCING TOOLS FOR FORMING HOLES SURROUNDED EACH BY A BOSS IN METAL PLATES OR THE WALL OF METAL TUBES

The invention relates to a rapidly rotatable piercing tool for forming, substantially by frictional heat and pressure, a hole surrounded by a boss in a metal plate or the wall of a metal tube, said tool having a tapered leading end portion, a second portion adjoining said end portion coaxially and having a shape which corresponds to the shape of the hole to be formed and a third portion adjoining the second portion coaxially and having a cross section, of which the area is larger than the largest cross sectional area of the second portion, so that this third portion projects from the second portion with a shoulder facing the second portion and serving the purpose of shaping and finishing the end face concerned of the boss of the hole.

The forming of bossed holes by means of a rotatable piercing tool of this kind can be done very quickly and with precision and it is important for fixing a tube or a transverse pipe, a burner or other body by a screwed joint to a plate or a tube which or the wall of which is too thin for the minimum number of threads required for such a joint. It appeared that, when the end face of the boss is so finished smooth by the shoulder of the third portion of the piercing tool as to ensure that it extends in a plane at right angles to the longitudinal axis of the tool this end face will acquire in an annular region bordering the hole a troublesome burr or thickening caused by the cutting of screw thread in the hole. Such a burr or thickening is detrimental to the seal between a shoulder of the body screwed in the plate or the tube wall and the end face of the boss surrounding the hole. This makes it necessary to finish the end face of the boss smooth again before the body is screwed in the hole and this finishing means additional work and tools and it increases the cost of forming the holes.

The invention has the object to provide a piercing tool, which forms in a plate or a tube wall a hole with a boss which is so shaped that the end face of the boss need not be trimmed to remove the burr or thickening caused by the cutting of screw thread. According to the invention this object is attained in that the shoulder of the third portion is so constructed, as not only to smooth the said end face but also to round off, to bevel off or to deepen in another way said end face towards the hole in an annular region bordering the hole, when, during the forming of the hole, it is forced against the boss. The significance of the local deepening of the end face is, that the burr or thickening caused by cutting screw thread in the hole will not axially project beyond other parts of said end face and therefore cannot affect the seal on the end face.

The shoulder of the third portion of the piercing tool may be constructed in different ways. Thus, it may be provided with at least one cutting edge having a material removing action on the end face of the boss surrounding the hole.

The piercing tool having one or more such cutting edges may be so constructed, as to have the (each) cutting edge lying in a (an individual) plane extending parallel to the longitudinal axis of the tool and to have it (each one of them) enclosing with a plane extending perpendicularly to said axis such an angle that the axial distance between the end of the cutting edge lying nearest to said axis and the leading point of the tool is smaller than the axial distance between said point and the end of the cutting edge lying most remote from said axis. Such a cutting edge forms in the end face of the boss a conical recess which is concentric with the hole.

In order to obtain a larger sealing area on the end face of the boss it is possible to use a piercing tool, of which the (each) cutting edge lies partly in the line of intersection of a (an individual) plane extending parallel to the longitudinal axis of the tool and a plane extending perpendicularly to said axis and partly in a transition portion formed on the third portion of the tool and rounding or bevelling off the angle between the second portion and the shoulder of the third portion.

If removal of material in the end face of the boss surrounding the hole must be avoided, a piercing tool can be used, of which the leading end portion and the second portion have cross sectional areas in the shape of polygons with rounded-off corners and in which the third portion of the tool is provided on its side facing the second portion with a transition portion rounding or bevelling off the corner between the second portion and the shoulder of the third portion and in which also this transition portion has cross sectional areas in the shape of polygons with rounded-off corners.

Figure 2:
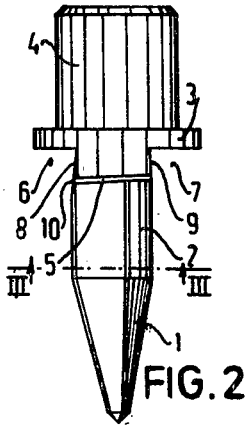
Figure 4:
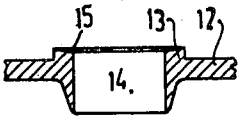
Figure 3:
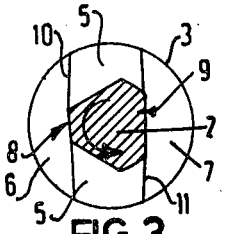
Figure 5:
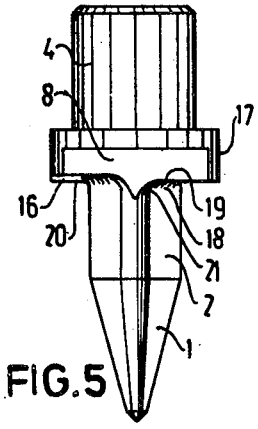
Figure 7:
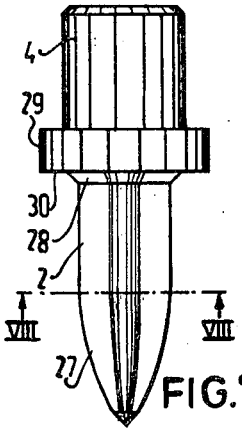
Figure 8:
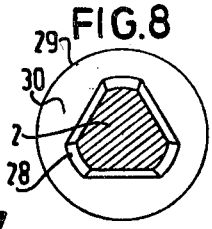
Figure 6:
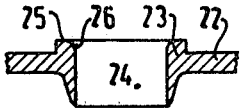
Figure 9:
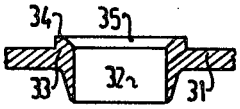

The invention will be further elucidated with the aid of the drawing. In the drawing show:

FIGS. 1 and 2 two elevational views at right angles to one another of a first embodiment of the piercing tool according to the invention, FIG. 3 a cross sectional view taken on line III—III in FIG. 2, FIG. 4 a sectional view of a plate with a hole formed by means of a piercing tool shown in FIGS. 1, 2 and 3, FIG. 5 an elevational view of a variant of the piercing tool shown in FIGS. 1, 2 and 3, FIG. 6 a sectional view of a plate with a hole formed by means of a piercing tool shown in FIG. 5, FIG. 7 an elevational view of still another piercing tool according to the invention, FIG. 8 a cross sectional view taken on line VIII—VIII in FIG. 7 and FIG. 9 a sectional view of a plate with a hole formed by means of the piercing tool illustrated in FIGS. 7, 8.

The piercing tool shown in FIGS. 1, 2 and 3 consists of a tapering leading end portion 1, a cylindrical second portion 2 adjoining said end portion coaxially, a head or third portion 3, of which the diameter is greater than those of the portions 1 and 2 and a stem 4 for the attachment of the piercing tool in the chuck of a machine tool having a spindle adapted to be rapidly rotated about its axis and to be axially moved.

The shoulder 5 of the third portion 3 of the piercing tool facing the second portion 2 thereof is ground away in two parallel segments 6 and 7, in such a way, that the planes 8 and 9 containing the chords of said segments enclose with the longitudinal axis of the tool acute angles. Furthermore, the two remaining parts of the shoulder 5 are each ground in an oblique direction both from the second portion 2 towards the peripheral edge of the third portion 3 and from the, during operation, leading edge towards the, during operation, trailing edge of the respective remaining part of the shoulder. Thereby the relieved cutting edges 10 and 11 are formed which border a cutting angle and lie in the vicinity of the cylindrical portion 2 nearer to the point of the piercing tool than they do near the edge of the head 3.

When the piercing tool is partly forced through a plate 12 (FIG. 4) the hole 14 surrounded by a boss 13 is formed by the portions 1 and 2 of the tool. The end face 15 of the boss 13 is cut by the cutting edges 10 and 11 of the head 3 into conical shape, so that it lies deeper at the edge of the hole 14 than at its outer edge. Now, when screw thread is cut in the wall of the hole 14 the lead of the thread causing a burr will not project upwards beyond the outer edge of the end face, so that this end face need not be trimmed to obtain a good seal against the shoulder of the body screwed in the hole 14.

The piercing tool illustrated in FIG. 5 differs from that shown in FIGS. 1, 2, 3 in that the shoulder 16 of the head 17 of the tool does not extend in an oblique direction towards the edge of the head and in that a rounded-off transition portion 18 is provided between the head 17 and the second portion 2 of the tool. Due thereto each cutting edge consists of a part 19, 20 crossing the longitudinal axis of the piercing tool at right angles and a part 21 which rounds the corner between the second portion 2 and the shoulder 16 of the head 17. This piercing tool forms in the plate 22 a hole 24 surrounded by a boss 23. The end face 25 of this boss lies partly in a plane extending at right angles to the longitudinal axis of the tool and it is rounded off at 26, that means at the edge of the hole 24.

Just as the piercing tool illustrated in FIGS. 1, 2, 3 and FIG. 5 the tool shown in FIGS. 7 and 8 is provided with a leading end portion and a second portion, the cross sectional areas of which have the shape of equilateral triangles with rounded-off corners. The end portion 27 of this piercing tool has generating lines which are, instead of straight, so bent as to make the end portion merge smoothly into the second portion 2. Also this piercing tool has a transition portion 28 extending between the head 29 and the second portion 2 of the tool. This transition portion 28 bevels the corner between the shoulder 30 of the head 29 directed transversely to the longitudinal axis of the piercing tool and the second portion 2. The cross sectional areas of the transition portion 28 have also the shape of equilateral triangles with rounded-off corners, as is shown in FIG. 8. The head of this tool is not provided with cutting edges, so that it has no cutting action on the end face of the boss surrounding the formed hole. This piercing tool forms as is shown in FIG. 9 in the plate 31 a cylindrical hole 32 which is surrounded by a boss 33, of which the, for the rest, plain end face 34 is bevelled at 35.

It will be apparent, that the rounded-off transition portion 18 of the piercing tool illustrated in FIG. 5 may be bevelled and that the bevelled transition portion 28 of the piercing tool shown in FIGS. 7 and 8 may be rounded-off. Furthermore, the piercing tools may have other cross sectional areas.

What I claim is:

1. A piercing tool comprising an elongate body having a shank portion at one end adapted to be gripped and rotated by a power tool, said tool having a tapered tip at that end opposite said shank portion, an intermediate portion joining said tip, and a third portion joining said intermediate portion to said shank portion, said tip and intermediate portion being of polygonal cross section presenting a plurality of side faces and longitudinally extending corners joining adjacent side faces, the corners of said intermediate portion extending parallel to the axis of said body and being disposed at the same radial spacing therefrom, the corners of said tip forming extensions of the corners of said intermediate portion whereby the tool may pierce a thin walled metal member and thereafter form, by frictional heat and pressure, an expanded hole through the metal member which is surrounded by a boss of substantially greater height than the thickness of the metal member and which projects from opposite sides of the members;

said third portion being of cylindrical form having a diameter greater than that of said boss to define a bottom face whereby the third portion overhangs said intermediate portion; and means only at the juncture of at least some of said corners of the intermediate portion and said bottom face of said third portion for bevelling the inside of said boss.

2. A piercing tool as defined in claim 1 wherein said means comprises a transition portion at the juncture of said at least some of said corners and said bottom face of said third portion.

3. A piercing tool as defined in claim 2 wherein each transition portion is concave.

4. A piercing tool as defined in claim 2 wherein each transition portion is in the form of an outward flare at each corner of the intermediate portion and extending to the bottom face of said third portion.

5. A piercing tool as defined in claim 1 wherein said means comprises a pair of flats formed in said third portion, one of said flats being essentially parallel with one side face of said intermediate portion and the other flat intersecting a corner of the intermediate portion, and said bottom face being provided with rake between said flats and upward radial taper whereby to present first and second bevel-cutting edges extending chordally from said at least some of said corners.

6. A piercing tool as defined in claim 5 wherein said means also includes transition portions joining said corners of the intermediate portion with said bottom face of the third portion.

* * * * *